US010821579B2

(12) United States Patent
Rajotte et al.

(10) Patent No.: US 10,821,579 B2
(45) Date of Patent: Nov. 3, 2020

(54) SCREW DRIVING DEVICE FOR USE WITH AN IMPACT DRIVER

(71) Applicant: Jacques Rajotte, Hood River, OR (US)

(72) Inventors: Jacques Rajotte, Whistler (CA); Kun-Lin Wu, Chung Her Li (TW)

( * ) Notice: Subject to any disclaimer, the term of this patent is extended or adjusted under 35 U.S.C. 154(b) by 154 days.

(21) Appl. No.: 15/344,807

(22) Filed: Nov. 7, 2016

(65) Prior Publication Data

US 2018/0126523 A1 May 10, 2018

(51) Int. Cl.
*B25B 23/00* (2006.01)
*B25B 23/12* (2006.01)

(52) U.S. Cl.
CPC ..... *B25B 23/0064* (2013.01); *B25B 23/0035* (2013.01); *B25B 23/12* (2013.01)

(58) Field of Classification Search
CPC ..... B25B 21/00; B25B 23/0064; B25B 21/02; B25B 23/0035; B25B 23/12; B25B 23/141; B25B 23/14; B25B 21/002; F16C 2361/43; F16D 13/10; F16D 15/00
See application file for complete search history.

(56) References Cited

U.S. PATENT DOCUMENTS 2,987,441 A 1/1961 Miles
3,767,218 A 10/1973 Linthicum et al.
4,287,923 A 9/1981 Hornung
4,647,260 A 3/1987 O'Hara et al.
4,753,142 A 6/1988 Hornung
5,188,378 A * 2/1993 Erlenkeuser ..... B25B 23/0035 279/22
5,380,132 A 1/1995 Parks
5,601,387 A 2/1997 Sanford et al.
5,996,452 A * 12/1999 Chiang ..... B25B 15/001 279/157
6,126,370 A * 10/2000 Wheeler ..... B23B 31/1207 279/30
6,192,776 B1 2/2001 Leitner
6,199,872 B1 3/2001 Hasan
6,364,318 B1 4/2002 Bedi et al.
6,520,509 B1 2/2003 Vasudeva et al.
6,536,537 B1 * 3/2003 Sasaki ..... B25B 21/00 173/176
6,543,959 B1 4/2003 Jore
6,637,755 B2 10/2003 Chen et al.
6,722,667 B2 * 4/2004 Cantlon ..... B23B 31/06 279/155
6,912,932 B2 7/2005 Kriaski et al.
6,931,967 B1 * 8/2005 Chang ..... B25B 15/001 81/125
7,086,313 B2 8/2006 Cantion
7,175,185 B2 * 2/2007 Chen ..... B25B 15/001 279/75
7,387,054 B2 * 6/2008 Rajotte ..... B25B 15/001 279/75
7,565,854 B2 * 7/2009 Chiang ..... B25B 15/001 279/75

(Continued)

*Primary Examiner* — Bryan R Muller

(57) ABSTRACT

A screw driving device for an impact driver has cylindrical clutch bearings with frustoconical inner ends that contact a screw bit retained by the screw driving device to drive a screw to a predetermined depth in a workpiece and release the screw bit in a clutched position that is achieved when the screw has been driven to the predetermined depth in the workpiece.

15 Claims, 9 Drawing Sheets

(56) References Cited

U.S. PATENT DOCUMENTS

| | | | | |
|---|---|---|---|---|
| 7,740,249 | B1 * | 6/2010 | Gao | B23B 31/1071 279/22 |
| 7,810,414 | B2 | 10/2010 | Hsu | |
| 7,823,483 | B2 | 11/2010 | Yamada | |
| 8,016,605 | B2 | 9/2011 | Montena et al. | |
| 8,287,547 | B2 | 10/2012 | Martin et al. | |
| 8,721,234 | B2 | 5/2014 | Santamarina et al. | |
| 9,302,377 | B2 * | 4/2016 | Rajotte | B25B 15/001 |
| 9,566,695 | B2 * | 2/2017 | Rajotte | B25B 23/0035 |
| 2002/0127070 | A1 | 9/2002 | Mawhinney | |
| 2012/0197311 | A1 * | 8/2012 | Kirschman | A61B 17/7064 606/304 |
| 2015/0122089 | A1 | 5/2015 | Rajotte | |

* cited by examiner

SCREW DRIVING DEVICE FOR USE WITH AN IMPACT DRIVER

FIELD OF THE INVENTION

The present invention relates to a screw driving device and, in particular, a screw driving device to control the depth at which a screw is driven into a work piece using an impact driver.

BACKGROUND OF THE INVENTION

Existing devices for driving screws using a power tool, such as an electric drill or an impact driver, are well known in the art, as characterized by Applicant's U.S. Pat. No. 9,302,377 B2, which issued on Apr. 4, 2016.

Such devices work extremely well when driven using an electric drill which provides a smooth, continuous drive force. However, longer and longer screws are now being used in the construction industry, and electric drills are not efficient at driving those screws. Consequently, impact drivers equipped with screw driving devices are being used to drive the long construction screws. The impact drivers provide the concussive torque required to drive the long construction screws while the screw driving devices control screw penetration depth in order to optimize screw holding strength.

However, observation has how shown that the concussive effect of driving screws with the impact driver can cause the round bearings of a screw driving device to spall the edges of a shank of a screw driving bit they retain in a drive position. When this happens, the bearings can no longer grip the shank of the screw driving bit and the bit turns freely in the drive position. Consequently, the screw driving bit has to be replaced before the screw driving tip of the bit has reached the limit of its service life. This is an undesirable situation.

It is therefore an object of the invention to provide a screwing device for use with an impact driver that is simple to construct and operates without spalling the edges of the screw driving bit they retain.

SUMMARY OF THE INVENTION

The invention therefore provides a screw driving device for use with an impact driver, comprising: a drive shaft having a drive end adapted to be engaged and driven by the impact driver and a socket end with an annular wall that forms a socket that receives and retains a screw bit, the annular wall having a plurality of radial bores which respectively receive a clutch bearing that engages the screw bit in a drive position and disengages the screw bit in a clutched position, the clutch bearing being a cylindrical body with a frustoconical end that engages the screw bit in the drive position; a hollow clutch sleeve having a top end, a bottom end and a central passage that receives the drive shaft, a top end of the central passage being sized to permit the drive end of the drive shaft to pass there through, but not permit the socket end of the drive shaft to pass there through, the hollow clutch sleeve having an annular groove in a bottom end of the central passage sized to receive the respective clutch bearings when the drive shaft is in the clutched position so that the frustoconical end of the clutch bearings disengage the screw bit but remain captured in the respective radial bores; a depth control sleeve that surrounds the bottom end of the hollow clutch sleeve, the depth control sleeve having a bottom end with a passage through which the screw bit extends; and a spring to urge the drive shaft towards the drive position.

The invention further provides a screw driving device for an impact driver, comprising: a drive shaft having a drive end adapted to be engaged and driven by the impact driver and a socket end with an annular wall that forms a socket that receives and retains a screw bit, the annular wall having a plurality of radial bores which respectively receive a clutch bearing that engages the screw bit in a drive position and disengages the screw bit in a clutched position to permit the screw bit to rotate freely with respect to the drive shaft in the clutched position, the clutch bearing being a cylindrical body having a rounded outer end and a frustoconical inner end that engages the screw bit in the drive position; a hollow clutch sleeve having a top end, a bottom end and a central passage that receives the drive shaft, a top end of the central passage being sized to permit the drive end of the drive shaft to pass there through, but not permit the socket end of the drive shaft to pass there through, the hollow clutch sleeve having an annular groove in a bottom end of the central passage sized to receive the respective outer ends of the clutch bearings when the drive shaft is in the clutched position so that the clutch bearings disengage the screw bit but remain captured in the respective radial bores; a depth control sleeve that surrounds the bottom end of the hollow clutch sleeve, the depth control sleeve having a bottom end with a passage through which the screw bit extends; and a spring that urges the drive shaft to the drive position.

The invention yet further provides a screw driving device for an impact driver, comprising: a drive shaft having a drive end adapted to be engaged and driven by the impact driver and a socket end with an annular wall that forms a socket that receives and retains a screw bit, the annular wall having a plurality of radial bores spaced apart in a first radial plane of the socket end and a plurality of radial bores spaced apart in a second radial plane of the socket end, the respective radial bores respectively receiving a clutch bearing that engages the screw bit in a drive position and disengages the screw bit in a clutched position to permit the screw bit to rotate freely with respect to the drive shaft in the clutched position, the clutch bearing being a cylindrical body having a rounded outer end and a frustoconical inner end that engages the screw bit in the drive position; a hollow clutch sleeve having a top end, a bottom end and a central passage that receives the drive shaft, a top end of the central passage being sized to permit the drive end of the drive shaft to pass there through, but not permit the socket end of the drive shaft to pass there through, the hollow clutch sleeve having two annular grooves in a bottom end of the central passage respectively sized to receive outer ends of the clutch bearings in one of the respective first and second radial planes when the drive shaft is in the clutched position so that the respective inner ends of the respective clutch bearings disengage the screw bit but remain captured in the respective radial bores; a depth control sleeve that surrounds the bottom end of the hollow clutch sleeve, the depth control sleeve having a bottom end with a passage through which the screw bit extends; and a spring that urges the drive shaft to the drive position.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

Figure 1:
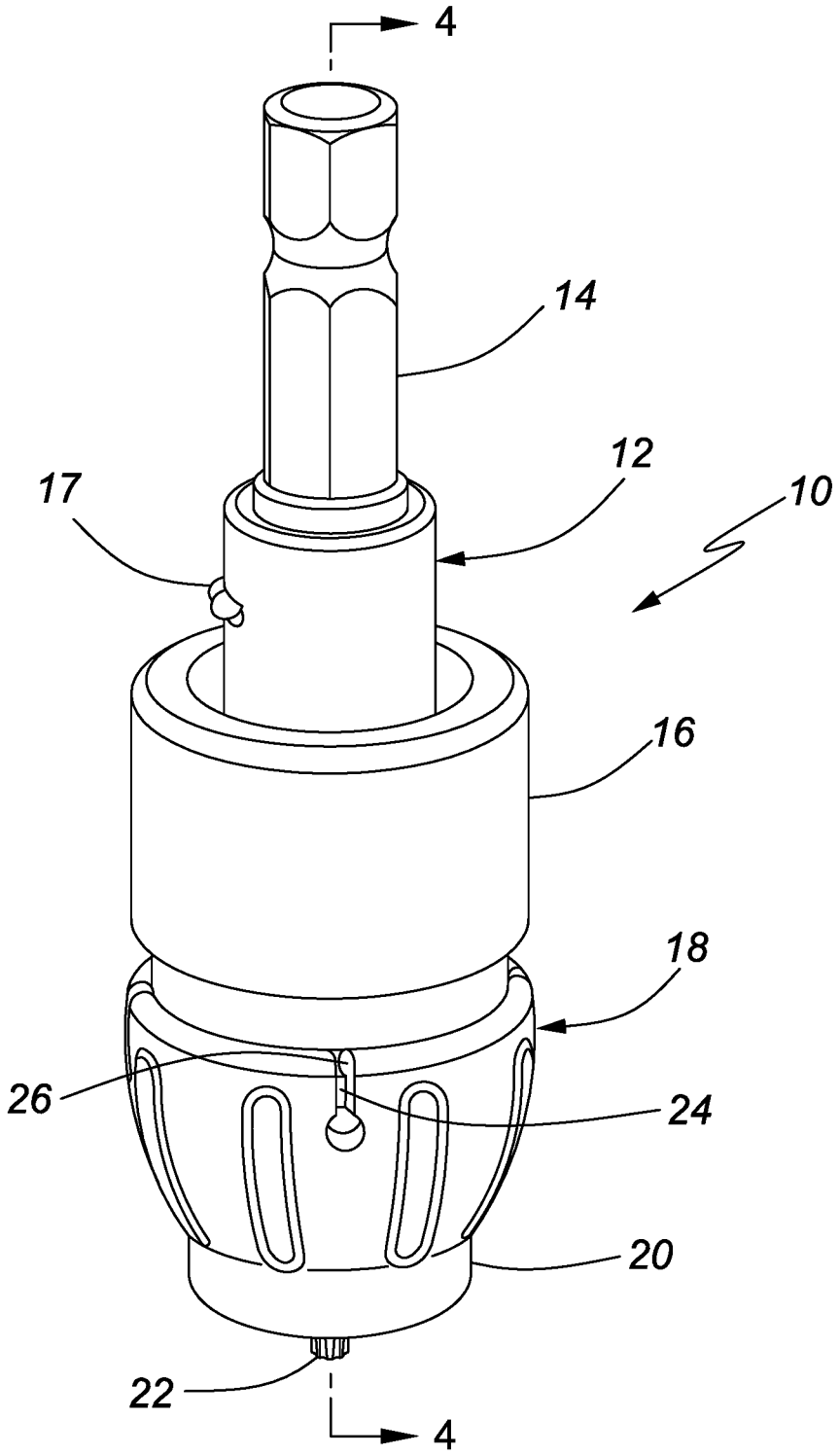
FIG. 1 is a perspective view a screw driving device in accordance with the invention.

FIG. 1 is a perspective view of a screw driving device 10 in accordance with the invention. The screw driving device 10 has a drive shaft 12 with a drive end 14 adapted to be engaged and driven by a portable electric impact driver (not shown), a hand tool that is well known in the art. A hollow clutch sleeve 16 receives the drive shaft 12. A lock boss 17 is formed on a side of the drive shaft 12 to lock the screw driving device 10 in a locked position for removing driven screws, as will be explained below with reference to FIG. 9. A nose cone 18 grips a bottom end of the hollow clutch sleeve 16, the nose cone 18 has a bottom end 20 through which extends a screw bit 22 received in a bottom end of the drive shaft 12. As will be explained below with reference to FIGS. 4-8, the screw bit 22 rotates with the drive shaft 12 when the screw driving device 10 is in a drive position and is released from driving engagement with the drive shaft 12 when the screw driving device 10 is in a clutched position. The depth control sleeve 18 is replaceable to permit a depth to which a screw is driven by the screw driving device 10 to be changed, if required, by attaching another depth control sleeve 18 having a different height. For this purpose, axial slits 24 in a top edge of the depth control sleeve 18 enable an inwardly protruding lip 26 of the depth control sleeve 18 to be disengaged from a correspondingly shaped groove 28 (see FIG. 4, for example) in the hollow clutch sleeve 16.

Figure 2:
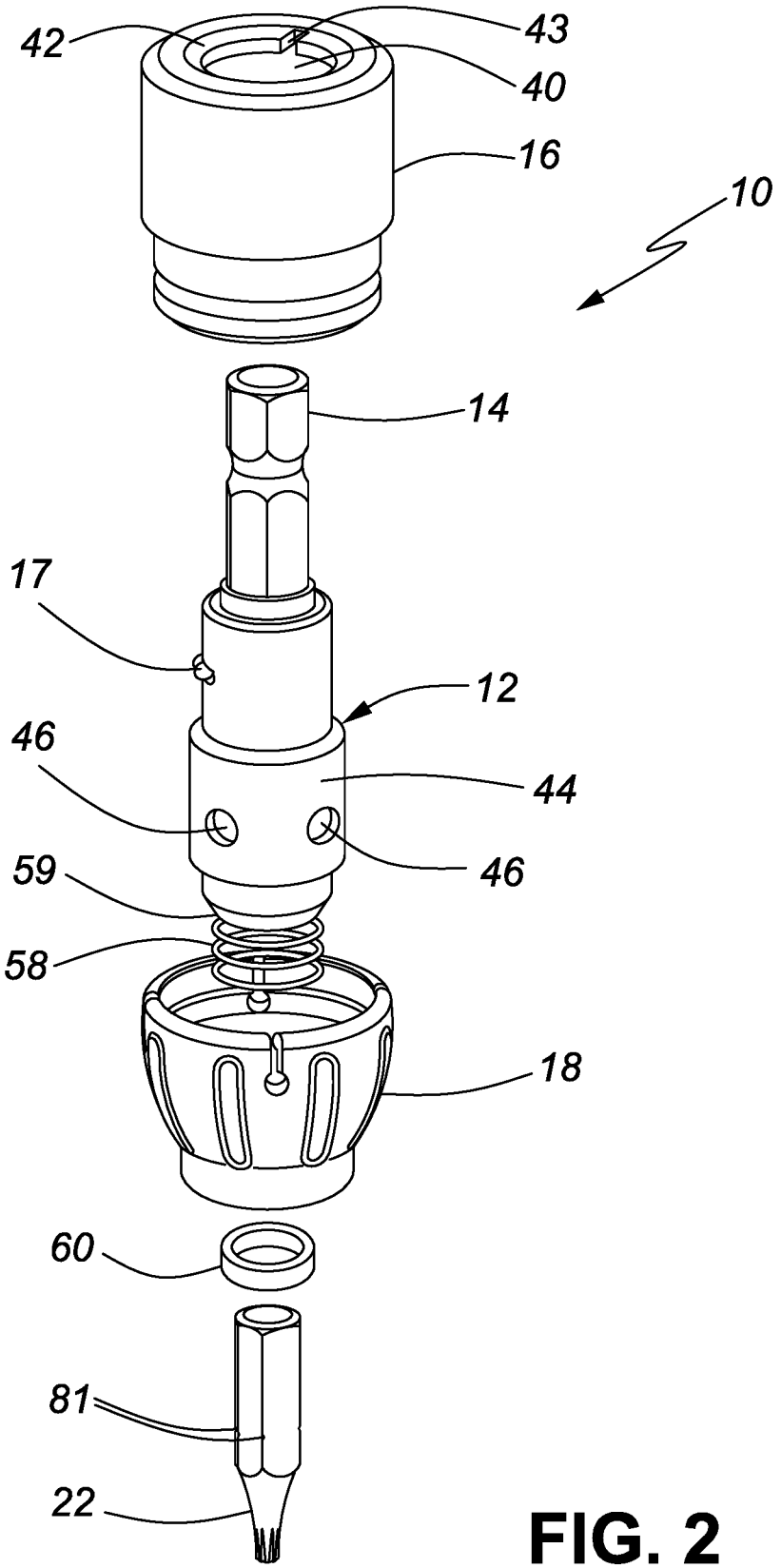
FIG. 2 is an exploded view of the screw driving device shown in FIG. 1.

FIG. 2 is an exploded view of the screw driving device 10 shown in FIG. 1. The drive end 14 of the drive shaft 12 extends through a central passage 40 in the hollow clutch sleeve 16. A top of the central passage 40 extends inwardly to form a stop 42 sized to permit the drive end 14 of the drive shaft 12 to pass through, but not permit a socket end 44 of the drive shaft 12 to pass through. A lock gap 43 in the stop 42 permits the lock boss 17 to pass through to lock the screw driving device in the locked position, which as noted above will be explained below with reference to FIG. 9. A plurality of radial bores 46 through the socket end 44 of the drive shaft 12 respectively house a clutch bearing 50 (see FIGS. 4-6). In this embodiment there are 3 radial bores 46 spaced 120° apart on a radial plane. The clutch bearings 50 engage the screw bit 22 in the drive position of the screw driving device, as will be explained below with reference to FIGS. 4, 5 and 6, so that the screw bit 22 rotates with the screw driving device 10. The clutch bearings 50 disengage from the screw bit 22 when the screw driving device 10 is in a clutched position, as will be explained below with reference to FIGS. 7 and 8, so that the screw bit is independent of rotation of the screw device 10, to control the depth to which a screw is driven by the screw driving device 10. A top end of a coil spring 58 rests against a bottom end 59 of the drive shaft 12, and a bottom end of the coil spring 58 engages an inner bottom surface of the depth control sleeve 18, as shown more clearly in FIGS. 4 and 5. The coil spring 58 urges the drive shaft 12 to the drive position of the screw driving device 10. A doughnut-shaped magnet 60 is received in a socket 62 (see FIGS. 4 and 5) in the bottom end 20 of the depth control sleeve 18. The magnet 60 magnetically attracts a steel screw (not shown) placed on the screw bit 22 so that the screw remains on the screw bit 22 until the screw is driven by the screw driving device 10.

Figure 3:
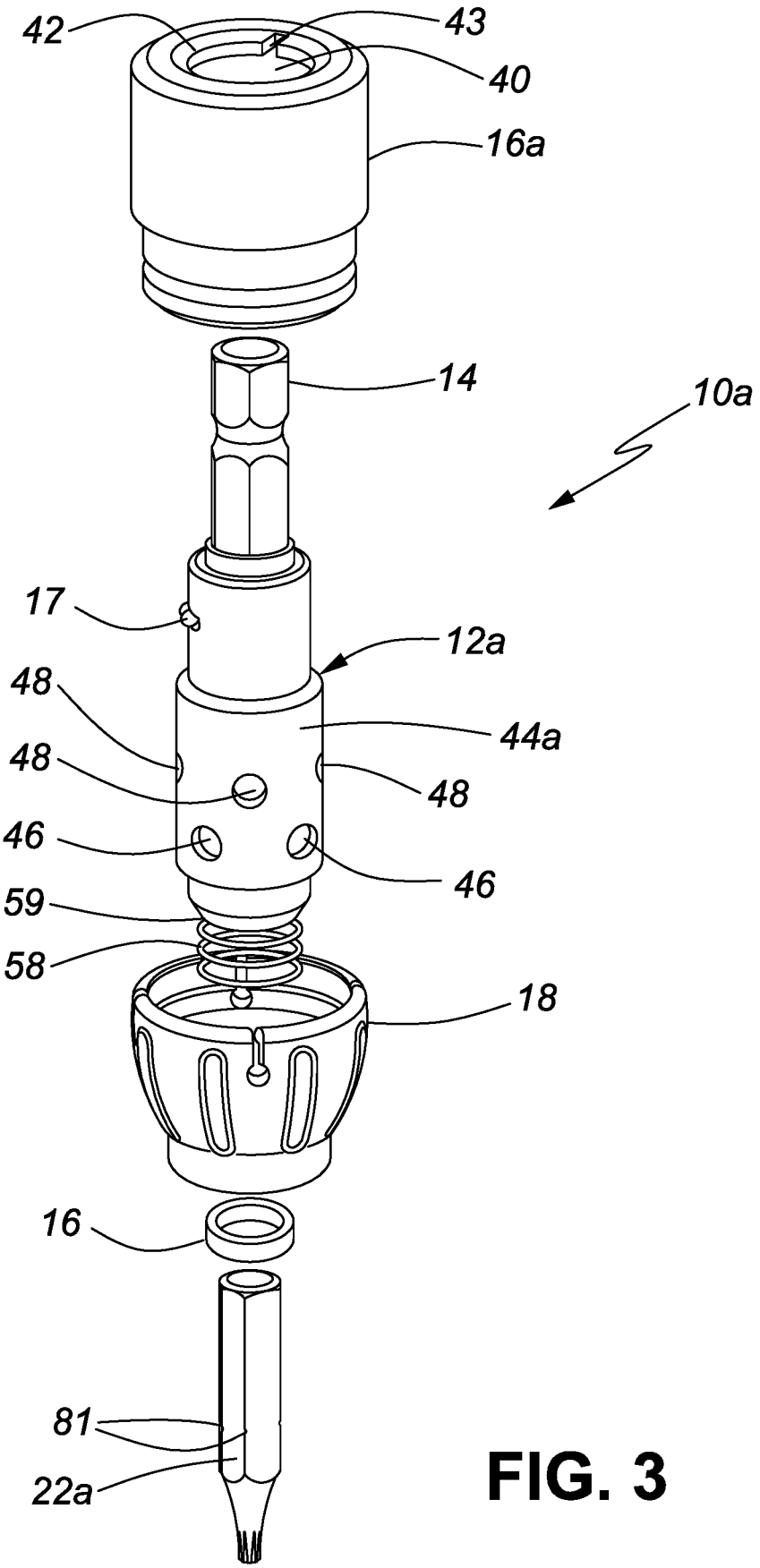
FIG. 3 is an exploded view of a second embodiment of the screw driving device shown in FIG. 1.

FIG. 3 is an exploded view of another embodiment 10*a* of the screw driving device 10 shown in FIG. 1. This embodiment 10*a* is identical to the embodiment 10 described above with reference to FIG. 2 except that a socket end 44*a* of a drive shaft 12*a* is longer than the socket end 44 of the drive shaft 12 shown in FIG. 2, a clutch sleeve 16*a* is correspondingly longer than the clutch sleeve 16, and the screw bit 22*a* is correspondingly longer than the screw bit 22 shown in FIG. 2. The extra length of the socket end 44*a*, the clutch sleeve 16*a* and the screw bit 22*a* is to accommodate a second plurality of radial bores 48 through the socket end 44*a* of the clutch sleeve 12*a*. Each of the radial bores 48 likewise house a clutch bearing 50, as will be explained below with reference to FIGS. 5 and 8. In this embodiment the radial bores 46 are spaced 120° apart on a first radial plane and the radial bores 48 are spaced 120° apart on a second radial plane above the first radial plane. Each radial bore 46 is spaced 60° from any adjacent radial bore 48.

Figure 4:
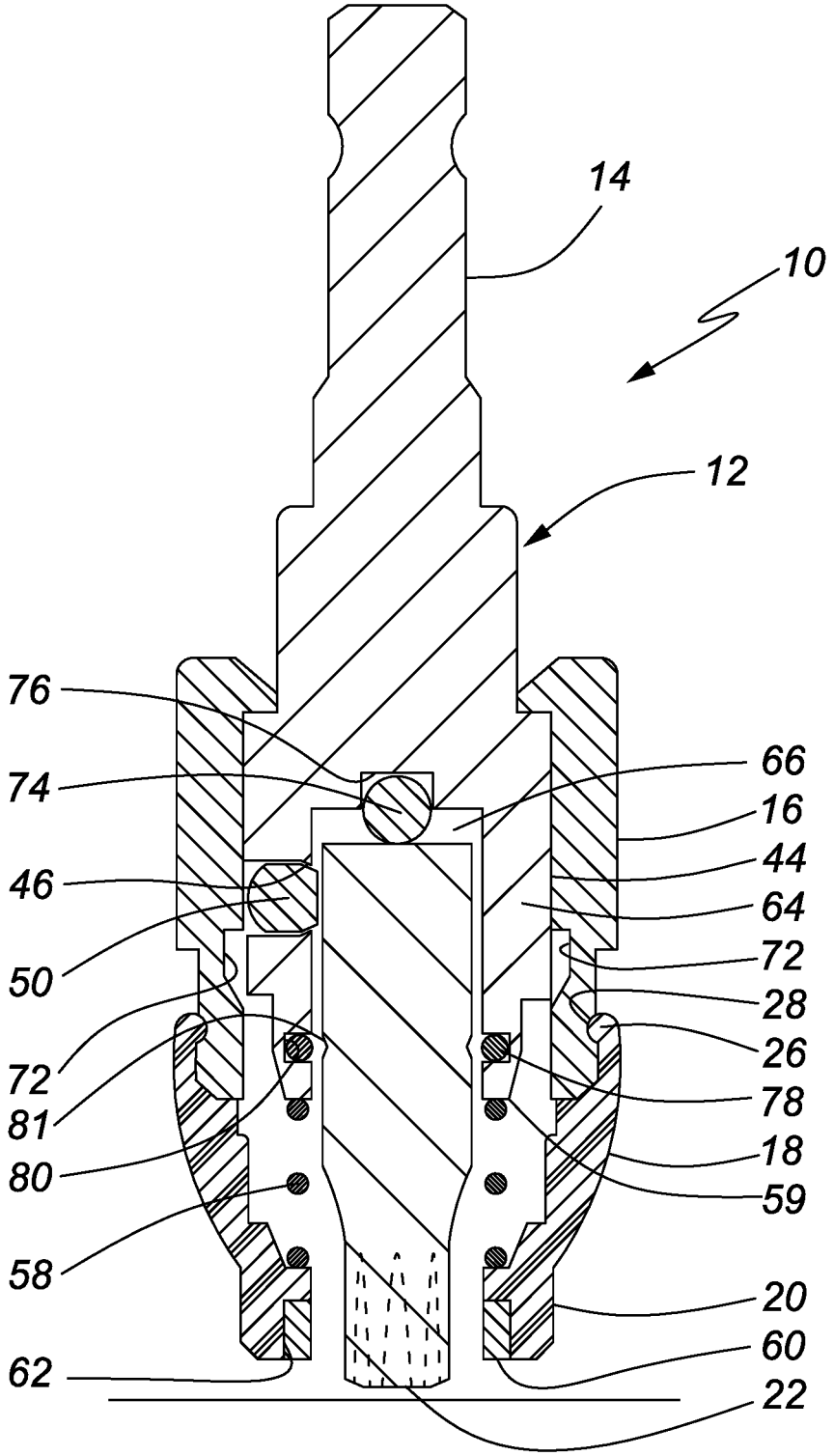
FIG. 4 is a cross-sectional view taken along lines 4-4 of FIG. 1 of the screw driving device shown in FIG. 2 in a drive position.

FIG. 4 is a cross-sectional view taken along lines 4-4 of FIG. 1 of the screw driving device 10 shown in FIG. 2 in the drive position in which rotation of the drive shaft 12 rotates the screw bit 22. The socket end 44 of the drive shaft 12 has an annular wall 64 that forms a socket 66 which receives and retains the screw bit 22. The annular wall 64 is pierced by the plurality of radial bores 46 (only one is shown in the cross-section, but, as explained above, typically there are three radial bores 46). The radial bores 46 respectively receive a clutch bearing 50 that engages a flat on the hexagonal screw bit 22 when the screw driving device 10 is in the drive position shown, and disengages the screw bit 22 in a clutched position shown in FIG. 7. The hollow clutch sleeve 16 has an annular groove 72 in a bottom end of the central passage 40 sized to receive the respective clutch bearings 50 when the screw driving device 10 is in the clutched position, so that the clutch bearings 50 disengage the screw bit 22 but remain captured in the respective radial bores 46. A ball bearing 74 friction fit in an axial bore 76 supports a top end of the screw bit 22 to permit the screw bit 22 to remain stationary while the drive shaft 12 rotates freely when the screw driving device 10 is in the clutched position, as will be explained below with reference to FIG. 7. A c-clip 78 captured in a radial groove 80 in the end of the socket 66 engages notches 81 in the screw bit 22 to removably retain the screw bit 22 in the socket 66.

Figure 5:
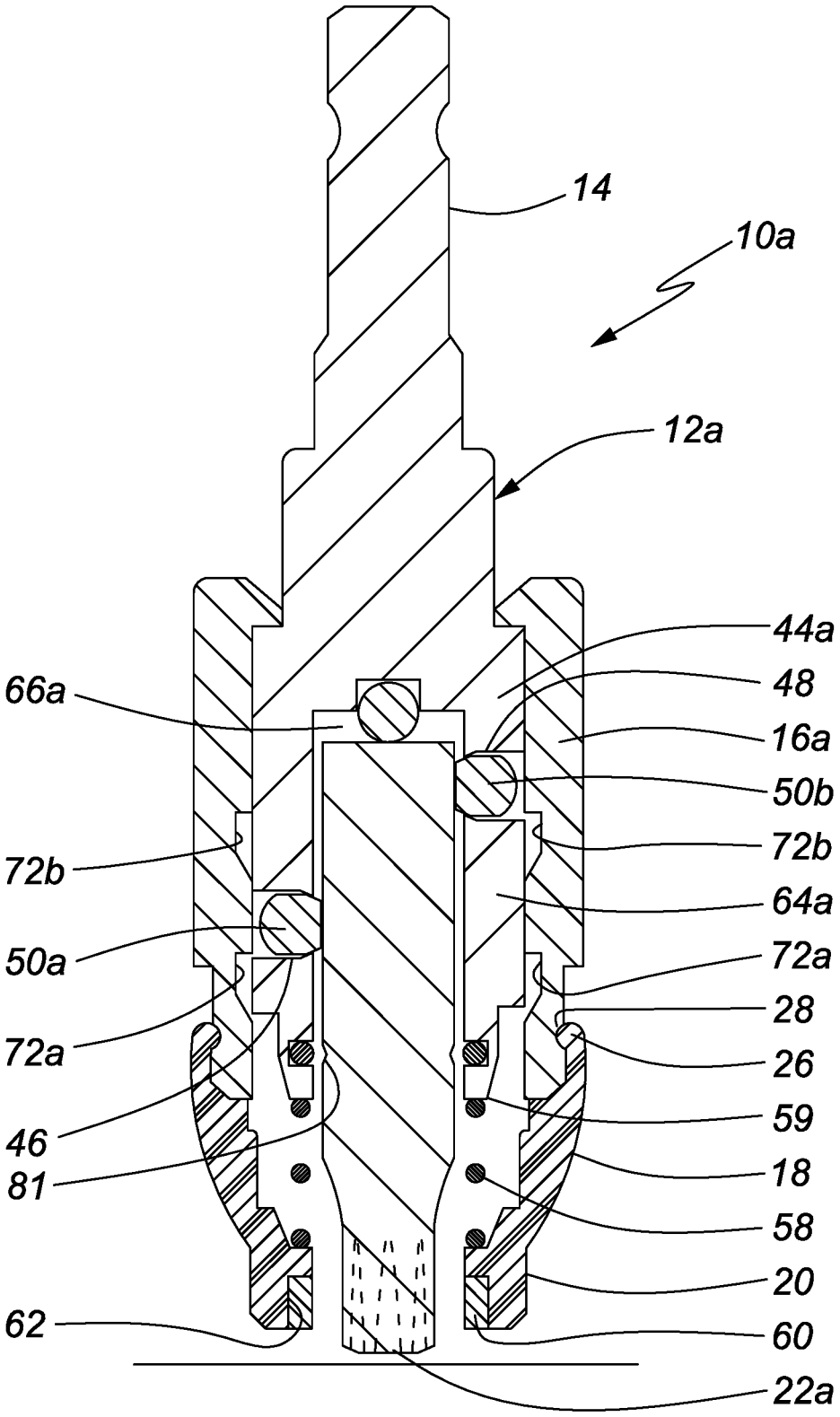
FIG. 5 is a cross-sectional view taken along lines 4-4 of FIG. 1 of the screw driving device shown in FIG. 3 in a drive position.

FIG. 5 is a cross-sectional view taken along lines 4-4 of FIG. 1 of the screw driving device 10*a* shown in FIG. 3 in the drive position in which rotation of the drive shaft 12 rotates the screw bit 22. The socket end 44*a* of the drive shaft 12*a* has an annular wall 64*a* that forms a socket 66*a* which receives and retains the screw bit 22*a*. The annular wall 64*a* is pierced by the plurality of radial bores 46, 48 (only one of each is shown in the cross-section, but, as explained above, typically there are three radial bores 46 and three radial bores 48). The radial bores 46 respectively retain a clutch bearing 50*a*, and the radial bores 48 respectively retain a clutch bearing 50*b* that respectively engage a flat on the hexagonal screw bit 22*a* when the screw driving device 10*a* is in the drive position shown, and respectively disengage the screw bit 22*a* in a clutched position shown in FIG. 8. The hollow clutch sleeve 16*a* has two annular grooves 72*a*, 72*b* in a bottom end of the central passage 40 sized to receive the respective clutch bearings 50*a*, 50*b* when the screw driving device 10*a* is in the clutched position, so that the clutch bearings 50*a*, 50*b* disengage the screw bit 22*a* but remain retained in the respective radial bores 46, 48. A ball bearing 74 friction fit in an axial bore 76 supports a top end of the screw bit 22*a* to permit the screw bit 22*a* to remain stationary while the drive shaft 12*a* rotates freely when the screw driving device 10*a* is in the clutched position, as will be explained below with reference to FIG. 8. A c-clip 78 captured in a radial groove 80 in the end of the socket 66 engages notches 81 in the screw bit 22 to removably retain the screw bit 22 in the socket 66.

Figure 6:
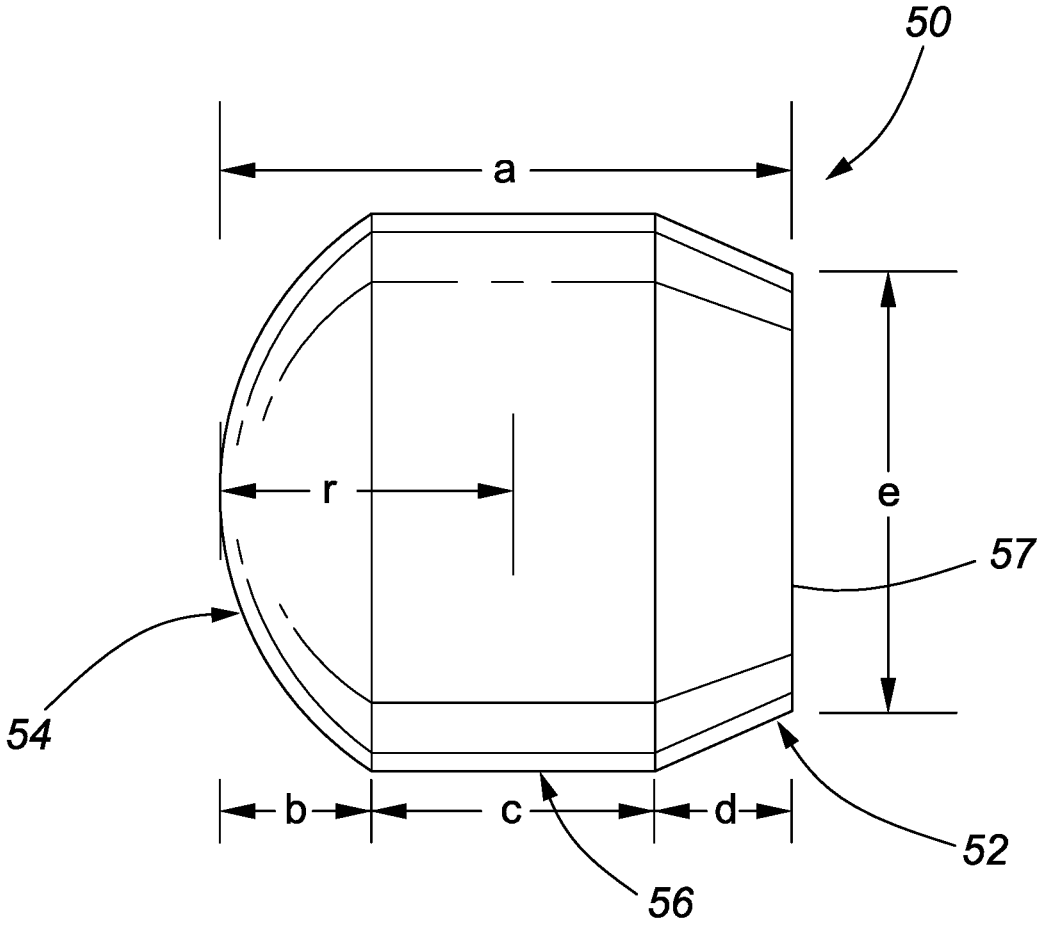
FIG. 6 is a detailed view of one of the clutch bearings of the screw driving devices shown in FIGS. 4 and 5.

FIG. 6 is a detailed view of one of the clutch bearings 50 of the screw driving devices shown in FIGS. 4 and 5. All of the clutch bearings 50, 50*a* and 50*b* are identical in size and shape. In one embodiment, the clutch bearings 50 are cylindrical bodies having a frustoconical inner end 52 and a rounded outer end 54. The cylindrical body has an overall length "a". A length "b" of the rounded end 54 is ¼ a (0.25a). A length "c" of a cylindrical midsection 56 is ½ a (0.5a); and, a length of the frustoconical inner end 52 is ¼ a (0.25a). A diameter of the midsection 56 is 1a (1.0a), and a diameter "e" of the flat 57 of the frustoconical end 52 is ¾ a (0.75a). A radius "r" of the rounded end 54 is ½ a (0.5a). In one embodiment, the clutch bearing 50 is 4 mm long, 4 mm in diameter and the cylindrical midsection is 2 mm long. A radius of the rounded end is 2 mm and the rounded end 54 is 1 mm long. The frustoconical end 52 is 1 mm long and the diameter of the flat 57 is 3 mm. It should be noted that both ends of the clutch bearing 50 may be frustoconical.

Figure 7:
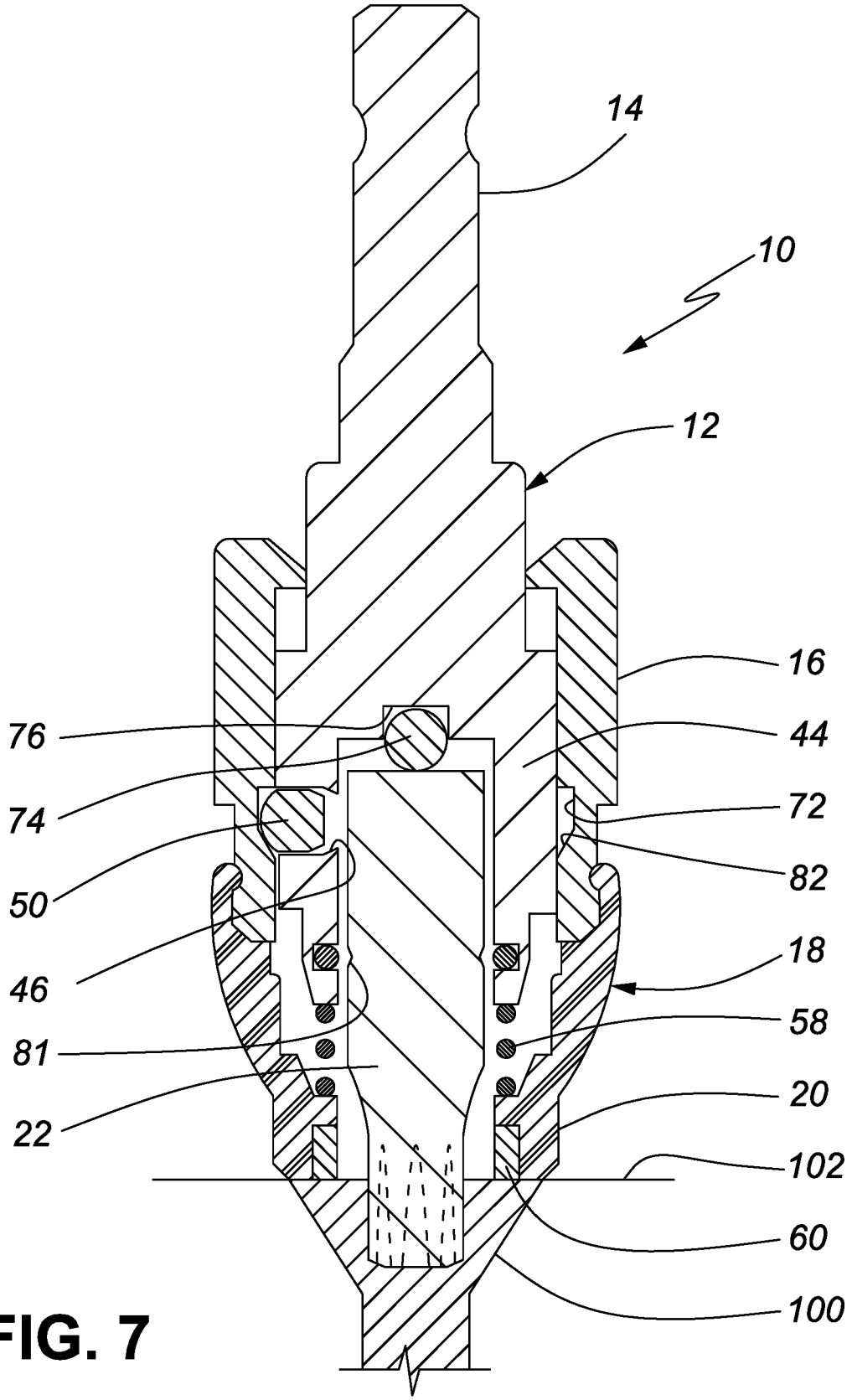
FIG. 7 is a cross-sectional view of the screw driving device shown in FIG. 4 in a clutched position.

FIG. 7 is a cross-sectional view of the screw driving device 10 shown in FIG. 4 in the clutched position in which the screw bit 22 is released from driving engagement with the respective clutch bearings 50 so that a screw 100 is no longer driven by the screw driving device 10. As the screw 100 is driven into a work surface 102, the bottom end 20 of the depth control sleeve 18 contacts the work surface 102 and the drive shaft 12 slides downward through the central passage 40 of the hollow clutch sleeve 16 as the screw 100 is driven into the work surface 102 until the respective radial bores 46 align with the annular groove 72 in the hollow clutch sleeve 16 and the respective clutch bearings 50 are forced outwardly into the annular groove 72 by pressure exerted by the screw bit 22 as it engages the driven screw 100. Once the respective clutch bearings 50 enter the annular groove 72, they are no longer in contact with the respective flats on the screw bit 22 and the screw driving device 10 is in the clutched position. Thus, even though the drive shaft 12 may continue to be rotated by the impact driver, the screw bit remains stationary and the screw is no longer driven. The depth to which the screw is driven into the work surface 102 is thereby controlled by the depth control sleeve 18. When downward pressure on the drive shaft 12 is released by an operator of the impact driver, and the screw driving device 10 is moved away from the work surface 102, the coil spring 58 urges the drive shaft 12 upwardly and the screw driving device 10 returns to the drive position shown in FIG. 4. As the screw driving device 10 returns to the drive position, an inclined bottom surface 82 of the annular groove 72 forces the respective clutch bearings 50 back into contact with respective flats of the screw bit 22.

Figure 8:
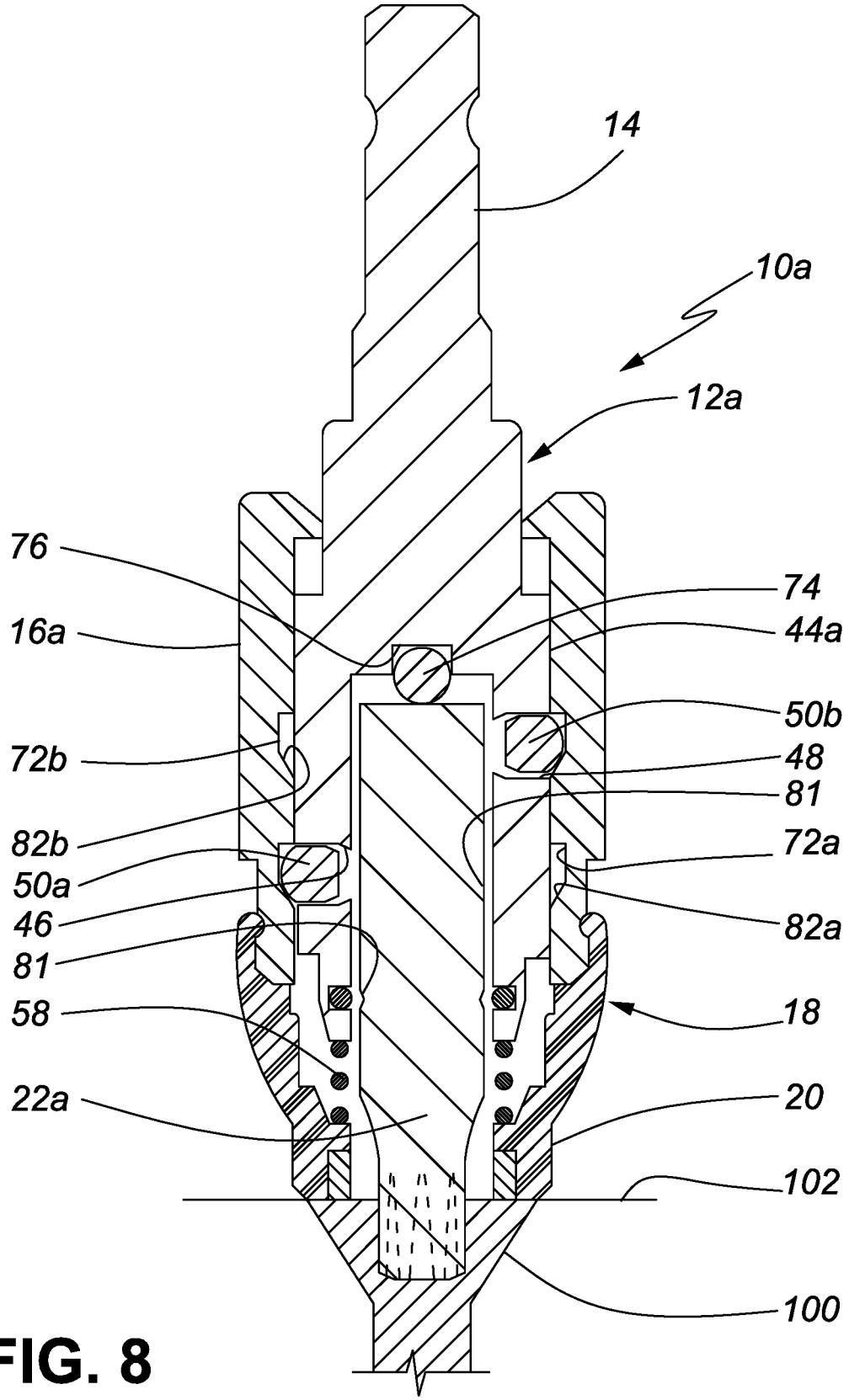
FIG. 8 is a cross-sectional view of the screw driving device shown in FIG. 5 in a clutched position.

FIG. 8 is a cross-sectional view of the screw driving device 10*a* shown in FIG. 5 in the clutched position in which the screw bit 22*a* is released from driving engagement with the respective clutch bearings 50*a*, 50*b* so that a screw 100 is no longer driven by the screw driving device 10*a*. As the screw 100 is driven into a work surface 102, the bottom end 20 of the depth control sleeve 18 contacts the work surface 102 and the drive shaft 12*a* slides downward through the central passage 40 of the hollow clutch sleeve 16*a* as the screw 100 is driven into the work surface 102 until the respective radial bores 46, 48 align with annular grooves 72*a*, 72*b* in the hollow clutch sleeve 16*a* and the respective clutch bearings 50*a*, 50*b* are forced outwardly into the annular groove 72*a*, 72*b* by pressure exerted by the screw bit 22*a* as it engages the driven screw 100. Once the respective clutch bearings 50*a*, 50*b* enter the respective annular grooves 72*a*, 72*b* they are no longer in contact with the respective flats on the screw bit 22*a* and the screw driving device 10*a* is in the clutched position. Thus, even though the drive shaft 12*a* may continue to be rotated by the impact driver, the screw bit 22*a* remains stationary and the screw 100 is no longer driven. The depth to which the screw is driven into the work surface 102 is thereby controlled by the depth control sleeve 18. When downward pressure on the drive shaft 12*a* is released by an operator of the impact driver, and the screw driving device 10*a* is moved away from the work surface 102, the coil spring 58 urges the drive shaft 12*a* upwardly and the screw driving device 10*a* returns to the drive position shown in FIG. 5. As the screw driving device 10*a* returns to the drive position, respective inclined bottom surfaces 82*a*, 82*b* of the respective annular grooves 72*a*, 72*b* forces the respective clutch bearings 50*a*, 50*b* back into contact with respective flats of the screw bit 22*a*.

Figure 9:
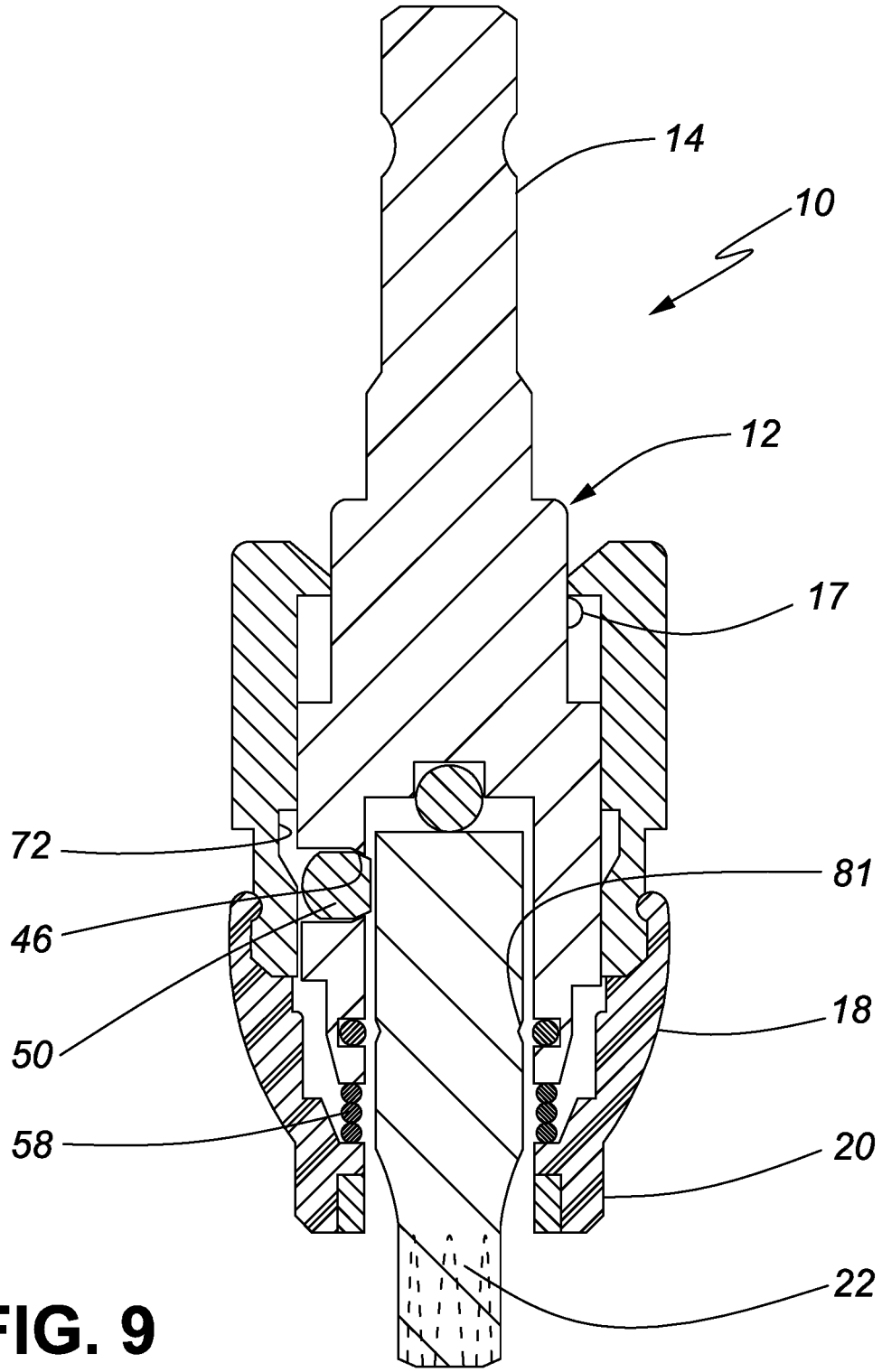
FIG. 9 is a cross-sectional view of the screw driving device shown in FIG. 4 in a locked position used to extract a driven screw.

FIG. 9 is a cross-sectional view of the screw driving device 10 shown in FIG. 4 locked in a reverse drive position typically used to extract a driven screw from a workpiece. In order to place the screw driving device 10 in the reverse drive position, the lock boss 17 is forced downwardly through the lock gap 43 (see FIG. 2) against the pressure of the coil spring 58, described above with reference to FIG. 2, and the hollow clutch sleeve is rotated far enough to capture the lock boss 17 below the stop 42 at the top end of the hollow clutch sleeve 16. In the reverse drive position, the respective clutch bearings 50 are below the annular groove 72 in the hollow clutch sleeve 16 and engage respective flats on the screw bit 22, so that rotation of the drive shaft 12 in either direction rotates the screw bit in the same direction. The screw driving device 10 is returned to the drive position show in FIG. 4 by turning the hollow clutch sleeve 16, while holding the drive shaft 12 stationary, until the lock boss 17 aligns with the lock gap 43 and is forced upwardly there through by the coil spring 58. The embodiment of the invention shown in FIGS. 5 and 8 is manipulated in exactly the same way to lock the screw driving device 10*a* in the reverse drive position.

The embodiments of the invention described above are intended to be exemplary only. The scope of the invention is therefore intended to be limited solely by the claims.

We claim:

1. A screw driving device for use with an impact driver, comprising:

a drive shaft having a drive end adapted to be engaged and driven by the impact driver and a socket end with an annular wall that forms a socket that receives and retains a screw bit, the annular wall having a plurality of radial bores which respectively each retain a clutch bearing that engages the screw bit in a drive position and disengages the screw bit in a clutched position, the clutch bearings respectively being a cylindrical body with a rounded outer end, the drive shaft being movable between a clutched position and a drive position to facilitate movement of the clutch bearing from the clutched position to the drive position, a frustoconical inner end that engages the screw bit in the drive position and a cylindrical midsection that extends from the rounded outer end to the frustoconical inner end, the cylindrical midsection having a length that is less than a diameter of a flat on the frustoconical inner end;

a hollow clutch sleeve having a top end, a bottom end and a central passage that receives the drive shaft, a top end of the central passage being sized to permit the drive end of the drive shaft to pass there through, but not permit the socket end of the drive shaft to pass there through, the hollow clutch sleeve having an annular groove in a bottom end of the central passage sized to receive the respective clutch bearings when the drive shaft is in the clutched position so that the frustoconical end of the clutch bearings disengage the screw bit but remain retained in the respective radial bores;

a depth control sleeve that surrounds the bottom end of the hollow clutch sleeve, the depth control sleeve having a bottom end with a passage through which the screw bit extends; and a spring to urge the drive shaft towards the drive position.

2. The screw driving device for an impact driver as claimed in claim 1 wherein the socket end of the drive shaft comprises 3 radial bores spaced 120 degrees apart on a radial plane of the socket end.

3. The screw driving device for an impact driver as claimed in claim 1 wherein the socket end of the drive shaft comprises 3 radial bores on a first radial plane of the socket end and 3 radial bores on a second radial plane of the socket end that is spaced apart from the first radial plane, and the hollow clutch sleeve comprises first and second spaced-apart annular grooves for receiving the clutch bearings retained in the radial bores on the first and second radial planes when the screw driving device is in the clutched position.

4. The screw driving device for an impact driver as claimed in claim 1 further comprising a lock boss on a side of the drive shaft above the socket end for locking the screw driving device in a reverse drive position used for extracting a driven screw from a workpeice.

5. The screw driving device for an impact driver as claimed in claim 4 further comprising at least one lock gap in the top end of the hollow clutch sleeve that permits the lock boss to pass through to lock the screw driving device in a reverse drive position when the lock boss is passed through the lock gap and the hollow clutch sleeve is rotated far enough to capture the lock boss within an interior of the hollow clutch sleeve.

6. The screw driving device for an impact driver as claimed in claim 1 further comprising spaced-apart axial slits in a top end of the depth control sleeve to permit the depth control sleeve to be removed and replaced with another depth control sleeve having a different length to change a depth to which a screw is driven in a workpiece.

7. The screw driving device for an impact driver as claimed in claim 1 wherein the bottom end of the depth control sleeve is smaller in diameter than the top end of the depth control sleeve.

8. The screw driving device for an impact driver as claimed in claim 1 wherein the bottom end of the depth control sleeve comprises a socket that surrounds the passage through which the screw bit extends, the socket receiving and retaining a doughnut shaped magnet that retains a screw on a bottom end of the screw bit when the drive shaft is in the drive position.

9. The screw driving device for an impact driver as claimed in claim 1 further comprising an annular groove in a bottom interior of the socket end of the drive shaft, the annular groove accepting a c-clip that engages the screw bit to releaseably retain the screw bit in the socket end of the drive shaft.

10. The screw driving device for an impact driver as claimed in claim 1 wherein the socket end of the drive shaft comprises 3 radial bores spaced 120 degrees apart on a first radial plane of the socket end and 3 radial bores spaced 120 degrees apart on a second radial plane of the socket end, and the hollow clutch sleeve comprises first and second annular grooves for receiving the outer ends of the clutch bearings of the plurality of bores on the first and second radial planes when the screw driving device is in the clutched position.

11. The screw driving device for an impact driver as claimed in claim 10 wherein the respective radial bores in the first radial plane are offset 60 degrees from each adjacent radial bore in the second radial plane.

12. The screw driving device for an impact driver as claimed in claim 11 wherein the depth control sleeve is detachable from the hollow clutch sleeve.

13. The screw driving device for an impact driver as claimed in claim 3 wherein the respective radial bores in the first radial plane are offset 60 degrees from each adjacent radial bore in the second radial plane.

14. The screw driving device for an impact driver as claimed in claim 3 wherein the depth control sleeve is detachable from the hollow clutch sleeve.

15. The screw driving device for an impact driver as claimed in claim 14 wherein a top edge of the depth control sleeve comprises axial slits to facilitate detachment of the depth control sleeve from the hollow clutch sleeve.

* * * * *